US011443601B2

(12) United States Patent
Dobashi et al.

(10) Patent No.: US 11,443,601 B2
(45) Date of Patent: Sep. 13, 2022

(54) ANTITHEFT DEVICE AND POWER GENERATOR ANTITHEFT SYSTEM

(71) Applicant: HONDA MOTOR CO., LTD., Tokyo (JP)

(72) Inventors: Manabu Dobashi, Wako (JP); Takashi Hashizume, Wako (JP); Tetsuya Matsuhisa, Wako (JP); Ryota Hisada, Tokyo (JP)

(73) Assignee: HONDA MOTOR CO., LTD, Tokyo (JP)

( * ) Notice: Subject to any disclaimer, the term of this patent is extended or adjusted under 35 U.S.C. 154(b) by 0 days.

(21) Appl. No.: 17/392,429

(22) Filed: Aug. 3, 2021

(65) Prior Publication Data

US 2021/0375108 A1 Dec. 2, 2021

Related U.S. Application Data

(63) Continuation of application No. PCT/JP2019/006818, filed on Feb. 22, 2019.

(51) Int. Cl.
*G08B 13/14* (2006.01)
*G08B 3/10* (2006.01)

(52) U.S. Cl.
CPC ..... *G08B 13/1427* (2013.01); *G08B 3/10* (2013.01)

(58) Field of Classification Search
None
See application file for complete search history.

(56) References Cited

U.S. PATENT DOCUMENTS 5,612,668 A * 3/1997 Scott ..... B60R 25/1012 340/8.1
5,886,634 A * 3/1999 Muhme ..... G08B 13/2454 340/5.31
6,297,737 B1 * 10/2001 Irvin ..... G08B 21/24 340/8.1
6,300,872 B1 * 10/2001 Mathias ..... G08B 21/0227 340/568.1

(Continued)

FOREIGN PATENT DOCUMENTS

JP 2003-254080 A 9/2003
JP 2006-146654 A 6/2006

(Continued)

OTHER PUBLICATIONS

International Search Report dated Apr. 16, 2019, issued in counterpart application No. PCT/JP2019/006818, w/English translation (3 pages).

(Continued)

*Primary Examiner* — Muhammad Adnan
(74) *Attorney, Agent, or Firm* — WHDA, LLP

(57) ABSTRACT

An antitheft device for a power generator electrically connectable to a work machine, comprising an acquisition unit configured to acquire position information from each of a plurality of power generators, a setting unit configured to set a single area including positions of the plurality of power generators as a movable area based on the position information acquired by the acquisition unit, and a notification unit configured to make a predetermined notification if at least one of the plurality of power generators has moved out of the movable area set by the setting unit.

8 Claims, 8 Drawing Sheets

(56) References Cited

U.S. PATENT DOCUMENTS 6,331,817 B1 * 12/2001 Goldberg ..... G08B 21/24 340/573.1
6,577,238 B1 * 6/2003 Whitesmith ..... G06K 7/10039 340/568.1
6,674,364 B1 * 1/2004 Holbrook ..... G08B 21/24 340/568.1
6,850,151 B1 * 2/2005 Calhoun ..... G04G 15/00 340/7.61
8,600,932 B2 * 12/2013 Poling ..... G06Q 10/10 137/551
8,928,463 B2 * 1/2015 Landau ..... G06K 7/10366 340/10.33
9,830,424 B2 * 11/2017 Dixon ..... G16H 40/67
10,149,142 B2 * 12/2018 Coulis ..... H04W 76/10
10,158,213 B2 * 12/2018 Burch ..... H02B 11/26
10,192,178 B2 * 1/2019 Kahle ..... G06Q 10/063118
10,380,883 B2 * 8/2019 Matson ..... H04L 67/306
10,769,939 B2 * 9/2020 Brown ..... G06F 21/629
10,943,471 B1 * 3/2021 Giobbi ..... G07C 9/00182
2002/0153418 A1 * 10/2002 Maloney ..... G08B 13/2417 235/384
2005/0110639 A1 * 5/2005 Puzio ..... G08B 13/2462 340/572.1
2006/0109090 A1 * 5/2006 Komatsu ..... B60R 25/33 340/426.19
2010/0145865 A1 * 6/2010 Berger ..... G06Q 10/08 340/572.1
2011/0282631 A1 * 11/2011 Poling ..... G01N 27/00 702/188
2014/0240088 A1 * 8/2014 Robinette ..... G08B 21/0219 340/5.61
2015/0277428 A1 * 10/2015 Dackefjord ..... G07C 9/00309 700/180
2018/0137729 A1 * 5/2018 Bottazzi ..... G08B 21/0261
2019/0027002 A1 * 1/2019 Esenwein ..... B25F 5/00

FOREIGN PATENT DOCUMENTS

JP 2008-179987 A 8/2008
JP 2011-55216 A 3/2011
JP 5066368 B2 * 11/2012

OTHER PUBLICATIONS

Written Opinion dated Apr. 16, 2019, issued in counterpart application No. PCT/JP2019/006818 (3 pages).

* cited by examiner

ANTITHEFT DEVICE AND POWER GENERATOR ANTITHEFT SYSTEM

CROSS-REFERENCE TO RELATED APPLICATION(S)

This application is a continuation of International Patent Application No. PCT/JP2019/006818 filed on Feb. 22, 2019, the entire disclosures of which is incorporated herein by reference.

TECHNICAL FIELD

The present invention mainly relates to an antitheft device for a power generator.

BACKGROUND ART

For example, it is considered that a portable power generator is carried into a work site such as a construction site or a building site, and a work machine is driven using the power generator (see PTL 1). In some cases, a plurality of power generators are carried into depending on the work scale, and the plurality of power generators remain left for a relatively long time. Hence, it is considered that the power generators may be detached and taken away without permission, that is, a theft may occur.

CITATION LIST

Patent Literature

PTL 1: Japanese Patent Laid-Open No. 2003-254080

SUMMARY OF INVENTION

Technical Problem

As a measure against the above-described theft of a power generator, a method of limiting an area where a power generator can be moved/carried and determining that a theft has occurred when the power generator is carried out of the area can be considered. However, since the power generator is carried to another work site after a predetermined work is completed, it is cumbersome to set the area in each work site, and this may lead to a decrease in work efficiency.

It is an exemplary object of the present invention to relatively easily implement antitheft of a power generator.

Solution to Problem

The first aspect of the present invention is related to an antitheft device, and the antitheft device is an antitheft device for a power generator electrically connectable to a work machine, comprising an acquisition unit configured to acquire position information from each of a plurality of power generators, a setting unit configured to set a single area including positions of the plurality of power generators as a movable area based on the position information acquired by the acquisition unit, and a notification unit configured to make a predetermined notification if at least one of the plurality of power generators has moved out of the movable area set by the setting unit.

Advantageous Effects of Invention

According to the present invention, it is possible to relatively easily implement antitheft of a power generator.

DESCRIPTION OF EMBODIMENTS

Figure 1:
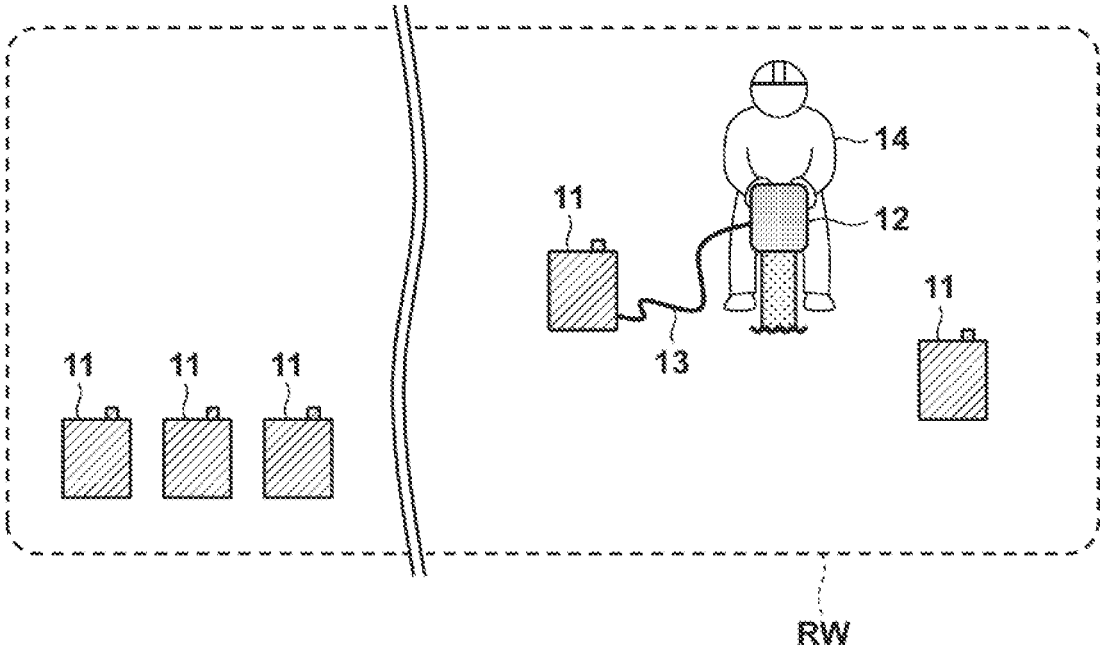
FIG. 1 is a schematic view for explaining an example of a work site.

Embodiments of the present invention will now be described with reference to the accompanying drawings. Note that the drawings are schematic views showing structures or configurations according to the embodiments, and dimensions shown in the drawings do not necessarily reflect the actuality. Note that the same reference numerals denote the same elements throughout the accompanying drawings, and a repetitive description will be omitted in the specification.

FIG. 1 is a schematic view for explaining an example of a work site such as a construction site or a building site. In a ground survey, a foundation work, and the like in a work site, heavy equipment (a construction machine such as a hydraulic excavator) capable of operating by itself is used, and a work machine capable of operating upon receiving power from an external power supply is also used. Examples of the work machine are relatively small or medium-sized electric tools such as an electric drill and a power saw. Other examples are apparatuses configured to assist works, such as a vibrator configured to prevent generation of bubbles in concrete, a concrete mixer, a lighting instrument that makes a work executable at night, and a heater configured to provide warmth. In a work site, a work is often performed under an environment without power supplies installed. Hence, to use a work machine as described above, an independent power generator is further carried in, and a work is performed using the power.

As shown in FIG. 1, a plurality of power generators 11 and a work machine 12 are carried into a work area RW of a work site. The plurality of power generators 11 are carried in as reserves/alternatives (to sufficiently supply power). Each power generator 11 is configured to be electrically connectable to the work machine 12 via a predetermined cable (or wire) 13 and can supply power to the work machine 12 by implementing the electrical connection. FIG. 1 shows the single work machine 12 to facilitate the description. However, two or more work machines 12 may be carried in. An operator 14 operates the work machine 12 connected to the power generator 11, and performs a predetermined work using the work machine 12.

Depending on the work scale, a work needs a relatively long time (for example, a half day to several days or more). Since the power generators 11 sometime remain left for a relatively long time in such a work site, it is considered that these may be stolen. An antitheft device configured to prevent a theft of the power generator 11 and a system thereof will be described below.

First Embodiment

Figure 2:
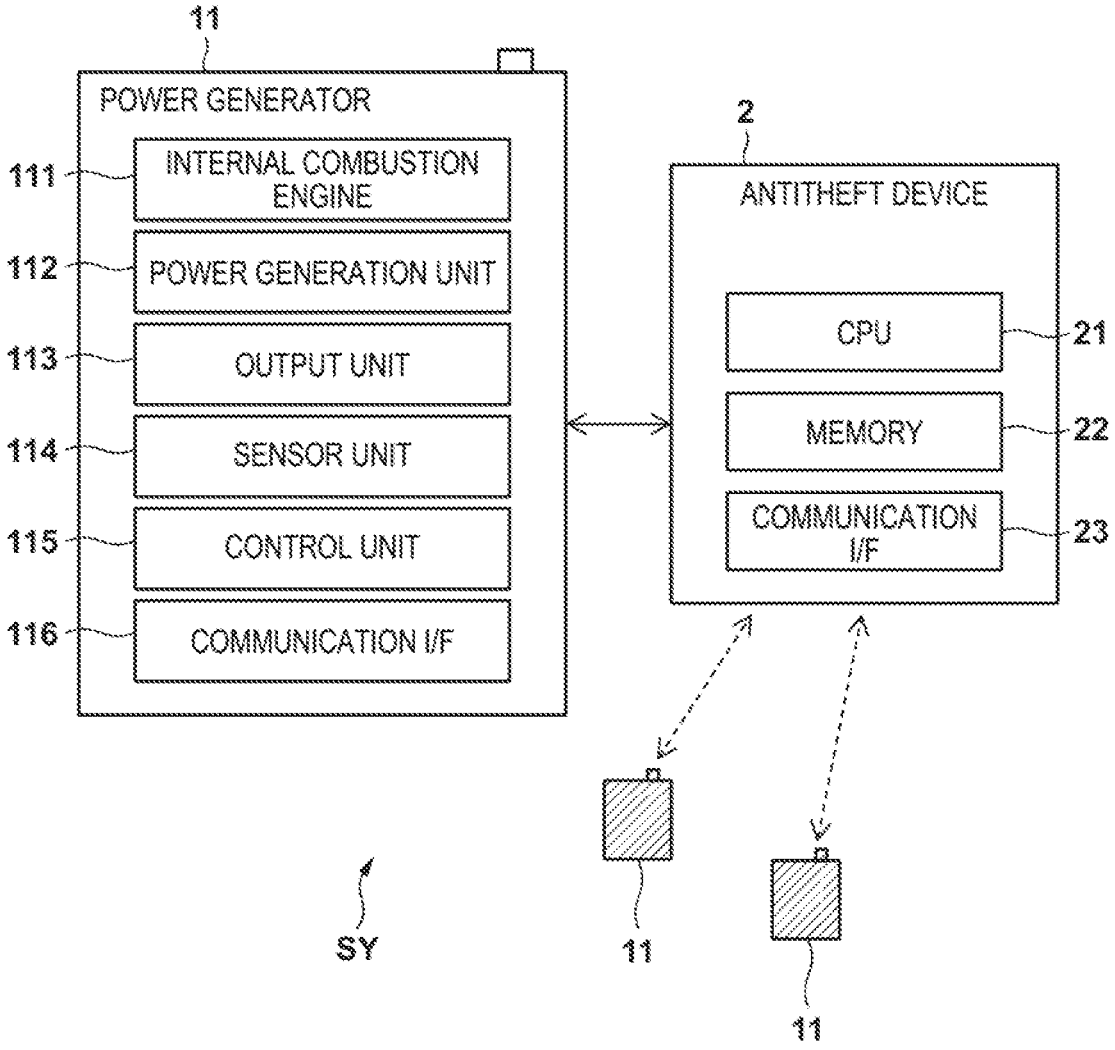
FIG. 2 is a block diagram for explaining an example of the configuration of an antitheft system.

FIG. 2 is a block diagram for explaining an example of the configuration of the power generator 11 and an antitheft system SY therefor according to the first embodiment. Note that an example of the configuration of one of the plurality of power generators 11 is shown here, and the remaining power generators 11 have the same configuration.

The power generator 11 includes an internal combustion engine 111, a power generation unit 112, an output unit 113, a sensor unit 114, a control unit 115, and an external communication interface 116. The internal combustion engine 111 changes to an operation state upon receiving start assist by a starter (not shown) and generates motive power. The power generation unit 112 generates power based on the motive power of the internal combustion engine 111. The output unit 113 can output the power of the power generation unit 112 to the outside and, in this embodiment, supplies the power to the work machine 12 connected via the cable 13 (see FIG. 1). The sensor unit 114 includes a position sensor configured to acquire information representing a self-machine position, for example, a GPS (Global Positioning System) sensor, as will be described later in detail.

The control unit 115 performs driving control of each element in the power generator 11, thereby implementing the function of the power generator 11. Also, the control unit 115 can perform signal communication with the outside via the external communication interface 116, as will be described later in detail. Note that the control unit 115 may be a semiconductor device such as an ASIC (Application Specific Integrated Circuit), or may be a CPU (central processing unit) and a memory. That is, the function of the control unit 115 may be implemented by any of hardware and software.

An antitheft device 2 is a device configured to prevent a theft of the plurality of power generators 11 and, in this embodiment, is a server including a central processing unit (CPU) 21, a memory 22, and an external communication interface 23. The antitheft device 2 is installed apart from at least the power generator 11. For example, the antitheft device 2 is installed in a temporary office near the work site or may be installed in an office of a company that has contracted for a work. With this configuration, the power generator 11 and the antitheft device 2 can communicate with each other via a predetermined network, thereby forming the power generator antitheft system (or simply antitheft system) SY.

Figure 3:
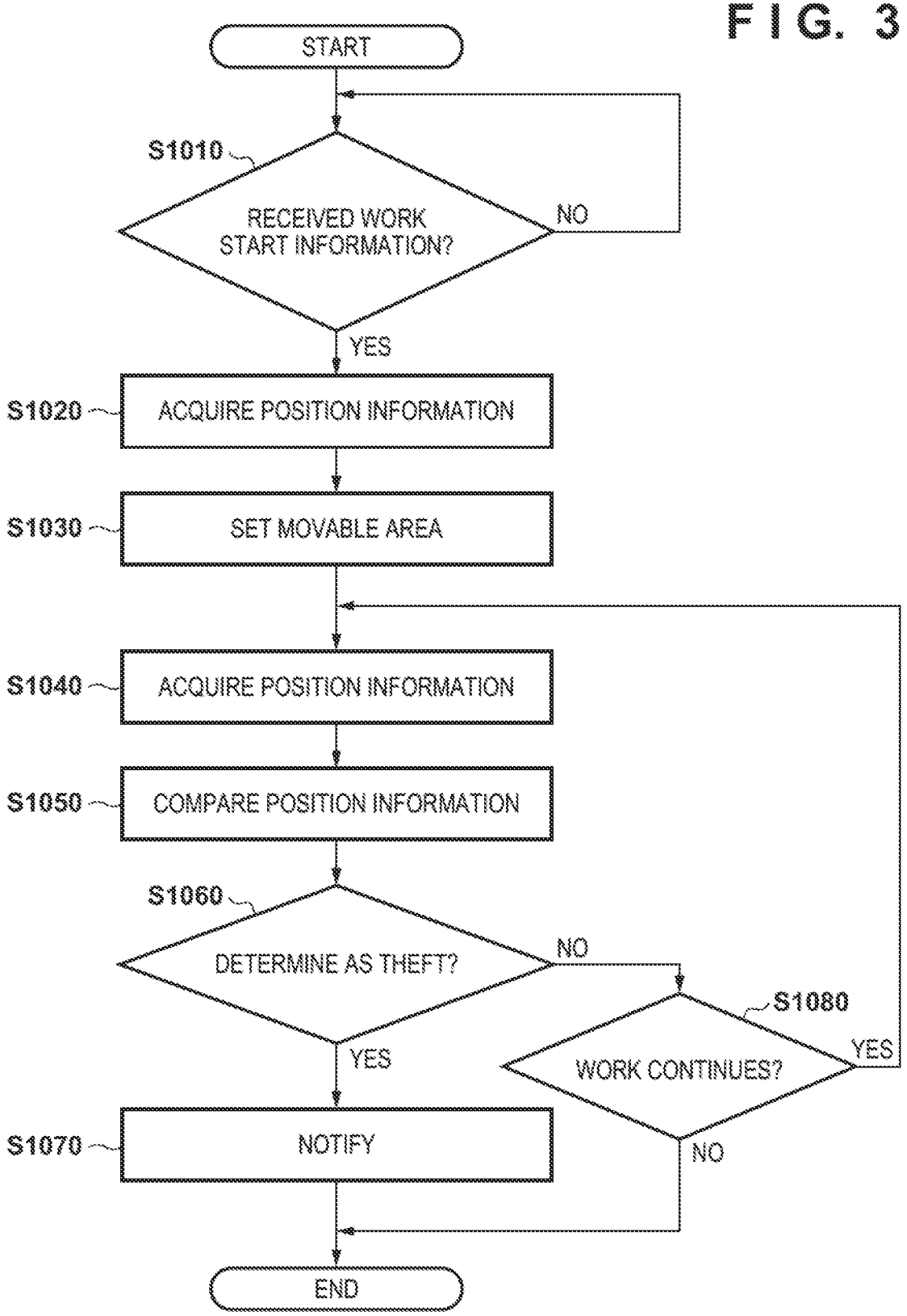
FIG. 3 is a flowchart for explaining an example of the operation contents of an antitheft device.

FIG. 3 is a flowchart for explaining the operation contents or processing contents of the antitheft device 2 in the system SY. Each step to be described here is mainly executed by the CPU 21 and the memory 22 in the antitheft device 2. Note that this flowchart can be started typically by operation input by an operator in the work site, and can be started in accordance with, for example, completion of initial settings (for example, settings concerning communication between the power generators 11 and the antitheft device 2) of the antitheft device 2 and the plurality of power generators 11.

First, in step S1010 (to be simply referred to as "S1010" hereinafter, and this also applies to the remaining steps), it is determined whether information (to be referred to as work start information hereinafter) representing that a work is started is received. As an example, when one of the plurality of power generators 11 changes to an operation state, the work start information is transmitted from the power generator 11 in the operation state to the antitheft device 2. As another example, when one of the plurality of power generators 11 is connected to the work machine 12, the work start information may be transmitted from the connected power generator 11 to the antitheft device 2. As still another example, when one of the plurality of power generators 11 is connected to the work machine 12, and the work machine 12 changes to the operation state, the work start information may be transmitted from the connected power generator 11 to the antitheft device 2. If the antitheft device 2 receives the work start information, the process advances to S1020. Otherwise, the process returns to S1010.

In S1020, position information is acquired from each of the plurality of power generators 11. This step is implemented when, for example, the antitheft device 2 requests position information from each power generator 11, and each power generator 11 that has received the request transmits position information obtained by the sensor unit 114 to the antitheft device 2. As another example, this step may be implemented when each power generator 11 periodically transmits position information to the antitheft device 2.

As will be described later in detail, in S1030, based on the pieces of position information of the plurality of power generators 11, which are acquired in S1020, a single area including the positions is set as a movable area for these. In S1040, position information is acquired from each of the plurality of power generators 11 in accordance with the same procedure as in S1020. In S1050, the position information obtained in S1040 is compared with the movable area set in S1030.

In S1060, the presence/absence of occurrence of a theft for the plurality of power generators 11 is determined based on the comparison result in S1050. More specifically, the antitheft device 2 determines whether any of the plurality of power generators 11 has moved out of the movable area. If any of the power generators 11 has moved out of the movable area, it is determined that the power generator 11 has been taken away without permission (a theft has occurred), and the process advances to S1070. Otherwise, the process advances to S1080.

In S1070, a predetermined notification is made based on the determination result (the occurrence of the theft) in S1060. As typical examples of the notification method, a notification (for example, mail) representing that a theft has occurred is transmitted to a portable terminal of a predetermined user (a manager, an operator, or the like in the work site), or a warning sound is generated. This allows the user to quickly confirm the state of the work site.

In S1080, it is determined whether the work is in a continuous state. If the work continues, the process returns to S1040. Otherwise (if the work is completed), the flowchart is ended. As described above, the work period can be relatively long in general. For this reason, in this embodiment, the determination of S1080 is performed based on operation input representing work completion to the antitheft device 2 by the user. If the operation input is not performed, the work is continued, although a temporary rest time or the like may be provided.

If no theft occurs, and the work continues, the process returns from S1060 to S1040 via S1080. One cycle of S1040, S1050, S1060, and S1080 is preferably performed at a predetermined period, for example, every several seconds or every several minutes. In other words, S1040 (acquisition of position information) is preferably performed at a predetermined period.

The above-described steps are implemented mainly when the CPU 21 executes a predetermined program in the antitheft device 2. As another embodiment, the steps may be implemented by a semiconductor device such as an ASIC. That is, the function of the antitheft device 2 described in this specification can be implemented by any of hardware and software. Also, the antitheft device 2 is a device mainly aiming at an antitheft function for the power generators 11 here, but may be a device auxiliarily having the function.

As a summary, the antitheft device 2 responds to reception of work start information (S1020), and sets the movable area of the plurality of power generators 11 based on the pieces of position information of these (S1030). After that, the antitheft device 2 acquires the pieces of position information of the plurality of power generators 11 at a predetermined period (S1040). If any (at least one) of the power generators 11 has moved out of the movable area, the antitheft device 2 determines that a theft of the power generator 11 has occurred (S1050 and S1060), and makes a predetermined notification (S1070).

When performing the above-described steps, existing map information may be referred to, and, for example, the pieces of position information and the movable area of the plurality of power generators 11 can be associated with the map information. This is advantageous in facilitating setting of the movable area and, if a theft has occurred, facilitating specifying of the power generator 11 that is a target of the theft.

Note that the movable area may be set once and then updated in accordance with satisfaction of a certain condition. For example, if it is determined in S1080 to continue the work, the process returns to S1020. As the condition for updating, for example, the elapse of a predetermined time, completion of some items of the work, or the like can be used.

The movable area is set based on the pieces of position information of the plurality of power generators 11, as described above. However, how to arrange each of the plurality of power generators 11 in the work area RW is arbitrarily decided by the user. Hence, in S1030, it is necessary to appropriately set the movable area irrespectively of how the individual power generators 11 are arranged. S1030 capable of implementing this is roughly divided into three processes. The three processes will be described below with reference to FIGS. 4 to 6.

Figure 4:
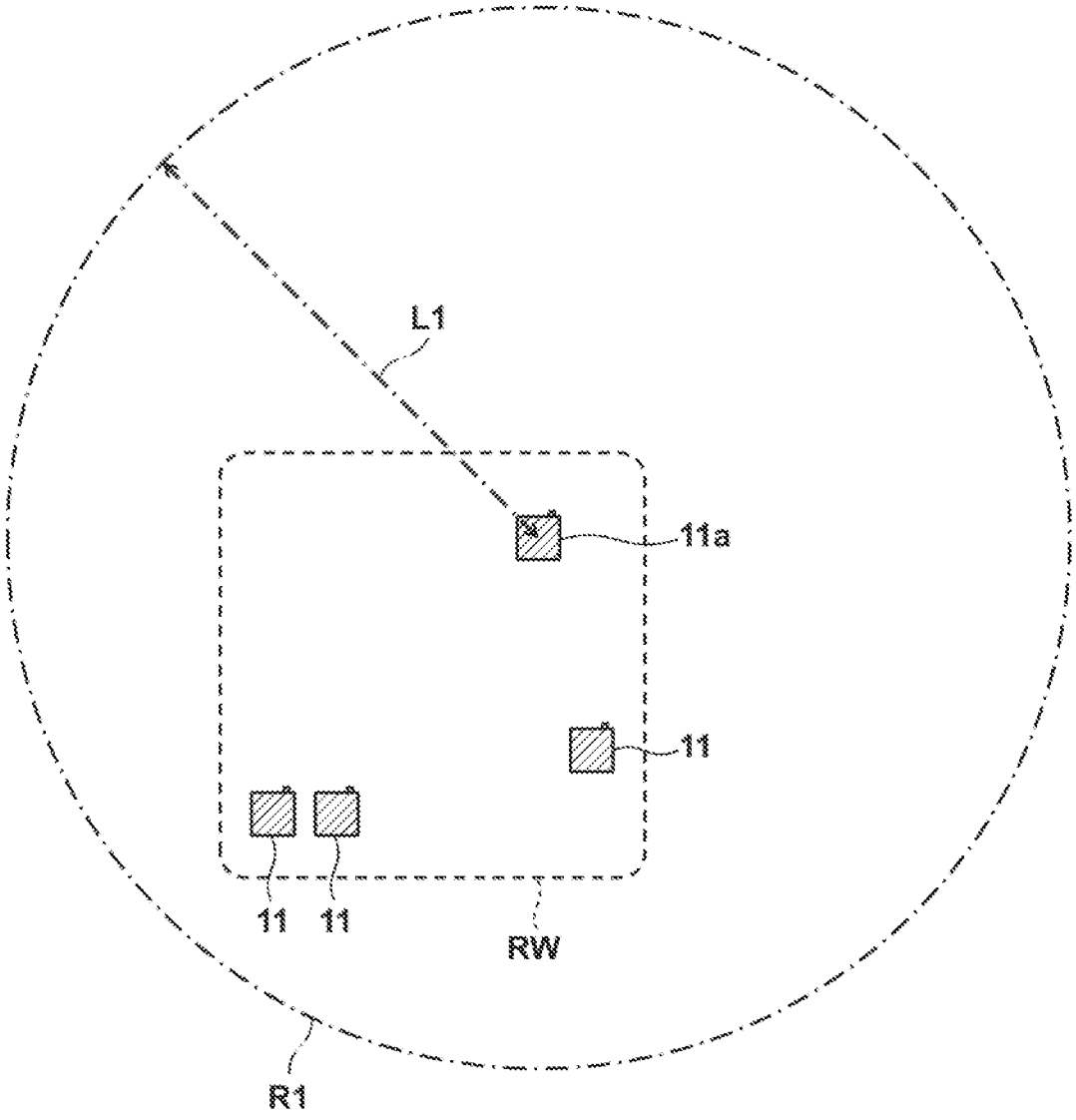
FIG. 4 is a schematic view for explaining a mode of a certain step of setting a movable area.

In the process shown in FIG. 4, one (defined as "power generator 11*a*" for the sake of discrimination) of the plurality of power generators 11 is specified, and after that, another power generator 11 highly associated with that is further specified. The specified power generators 11*a* and 11 are registered in the antitheft device 2 (for example, the memory 22) as targets to be protected from a theft.

The power generator 11*a* is, for example, one of the plurality of power generators 11, which serves as a trigger to start a work. In this embodiment, the transmission source of the work start information in S1010 is preferably selected as the power generator 11*a*. For example, if one of the plurality of power generators 11 changes to the operation state, if one of the plurality of power generators 11 is connected to the work machine 12, or if the work machine 12 changes to the operation state, the power generator 11 can be set as the power generator 11*a*.

Using the thus specified power generator 11*a* as a starting point or a reference, another power generator 11 highly associated with that is further specified. Whether a power generator is highly associated or not can be decided based on the distance from the power generator 11*a*. Hence, for example, another power generator 11 within an area R1 of a distance L1 from the power generator 11*a* is specified as a highly associated power generator. As the distance L1, a value larger than at least the width (a width of a maximum value) of the work area RW in a planar view is preferably set in advance. Alternatively/additionally, as another embodiment, another power generator 11 within the distance L1 from the work machine 12 connected to the power generator 11*a* may be specified as a highly associated power generator.

The power generators 11 and 11*a* specified in the above-described way are registered in the antitheft device 2 as power generators to be used in the work area RW, and protected from a theft.

Figure 5:
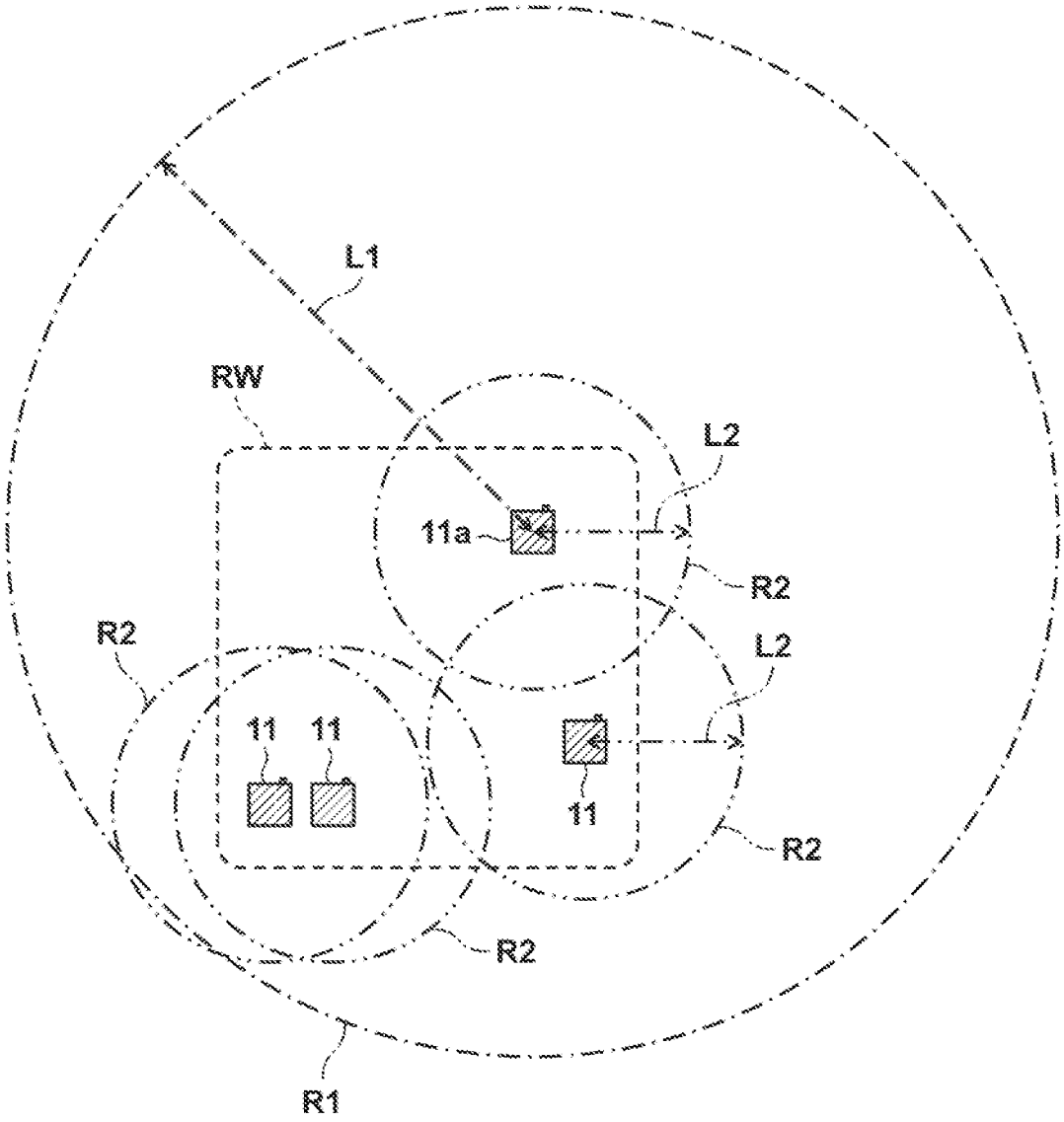
FIG. 5 is a schematic view for explaining a mode of a certain step of setting a movable area.

In the process shown in FIG. 5, an area R2 of a distance L2 from each of the power generators 11 and 11*a* is set. An arbitrary value is preferably set to the distance L2 in advance, and a value smaller than the distance L1 may be set. For example, depending on the shape of the work area RW, the distance L2 may be set to a value equal to or smaller (by, for example, about 0.4 to 0.6 times) than the distance L1. The value of the distance L2 may be set by the user based on map information, or may be set based on the result of classification (for example, a type based on pattern matching) of the work area RW by the antitheft device 2. As another embodiment, the area R2 may be set for the work machine 12 connected to the power generator 11*a* in place of/in addition to the area R2 for the power generator 11*a*.

Figure 6:
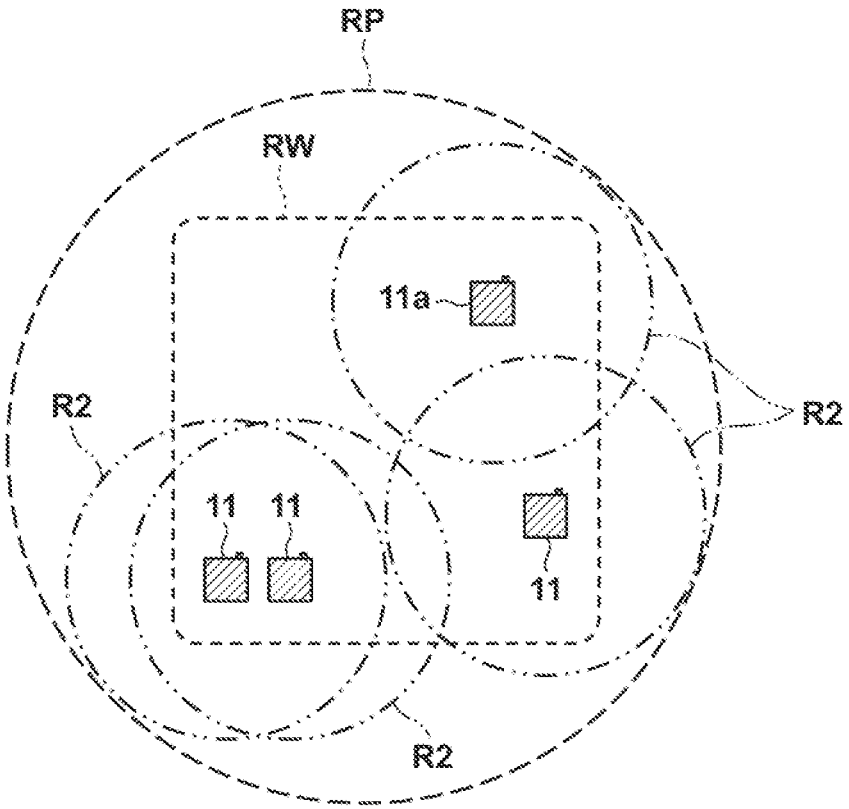
FIG. 6 is a schematic view for explaining a mode of a certain step for setting a movable area.

In the process shown in FIG. 6, a single area enveloping the plurality of set areas R2 is set as the above-described movable area (to be referred to as an "area RP"). That is, the movable area RP is set in contact with all the plurality of areas R2. To easily set the movable area RP, all the areas R2 and RP are preferably substantially set to a circular shape in a planar view.

As a summary, S1030 for setting the movable area RP is roughly divided into the three processes described with reference to FIGS. 4 to 6. First, in the process shown in FIG. 4, the power generator 11 within the distance L1 (in the area R1) from the power generator 11*a* serving as the trigger of the start of a work is specified. Next, in the process shown in FIG. 5, the area R2 of the distance L2 from each of the specified power generators 11 and the power generator 11*a* is specified. After that, in the process shown in FIG. 6, a single area enveloping all the areas R2 is set as the movable area RP.

According to the procedure as described above, the movable area RP for the plurality of power generators 11 can appropriately be set and used for S1050 (comparison of position information) and S1060 (determination of the presence/absence of occurrence of a theft) later. In many cases, a company that contracts for a work can own more power generators 11. However, according to this embodiment, since the highly associated power generators 11 are specified in the process shown in FIG. 4, it is possible to prevent the movable area RP from being set based on the pieces of position information of irrelevant power generators 11.

According to this embodiment, based on the pieces of position information of the plurality of power generators 11, which are acquired in S1020, the antitheft device 2 sets a single area enveloping the positions of the plurality of power generators 11 as the movable area RP in S1030. After that, the antitheft device 2 acquires the position information of each power generator 11 during continuation of the work, for example, at a predetermined period (S1040), and if any (at least one) of the plurality of power generators 11 has moved out of the movable area RP, a predetermined notification is made (S1050 to S1070). According to this embodiment, for example, the movable area RP can appropriately be set without substantially increasing the burden on the operator, and a theft of the power generator can be prevented relatively easily. In addition, the power generator antitheft system SY can be implemented by the relatively simple configuration, and antitheft can be implemented at relatively low cost.

Second Embodiment

Figure 7:
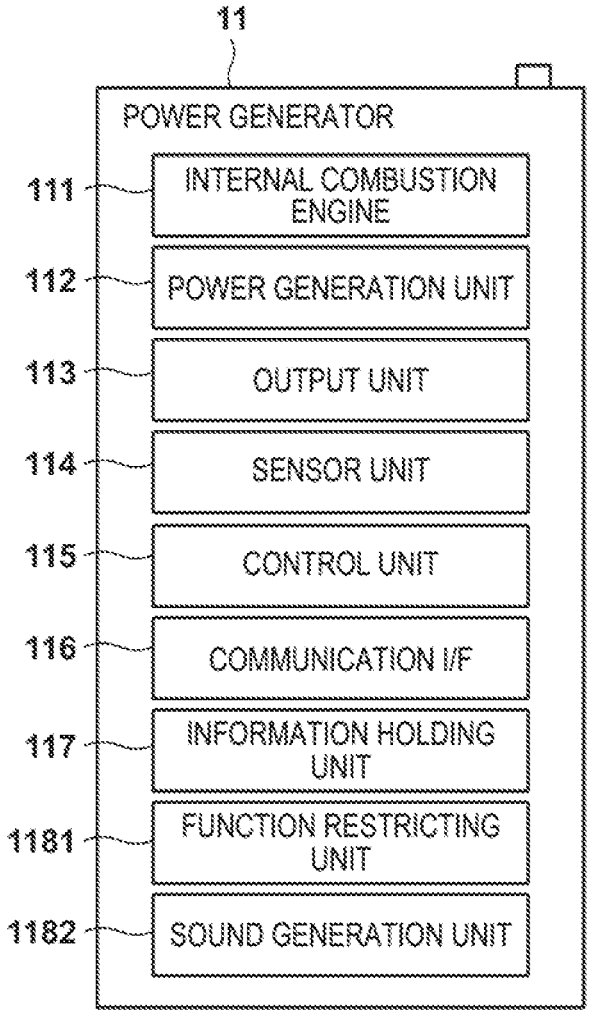
FIG. 7 is a block diagram for explaining an example of the configuration of a power generator.

FIG. 7 shows the configuration of a power generator 11 according to the second embodiment. The power generator 11 may further include a variety of functions. In this embodiment, the power generator 11 further includes an information holding unit 117, a function restricting unit 1181, and a sound generation unit 1182.

The information holding unit 117 holds, as user information, information used to specify that the power generator 11 is the user' own one. Examples are belonging information representing an owner or a company, and identification information. The user information is used in S1020 and S1040 (acquisition of position information). This can prevent, for example, an irrelevant power generator (for example, a power generator of a different owner) from being set to a target to be protected from a theft. Also, in S1030, since a movable area RP is not set based on the position information of an irrelevant power generator, the movable area RP can be more appropriately set.

The function restricting unit 1181 is configured to restrict the operation of the power generator 11 and, for example, maintains an internal combustion engine 111, a power generation unit 112, and/or an output unit 113 in a rest state using a predetermined disable signal. For example, if occurrence of a theft is detected in S1060, an antitheft device 2 outputs, to the power generator 11 as the target of the theft, a control signal for restricting the operation of the power generator 11. The function restricting unit 1181 restricts the operation of the power generator 11 based on the control signal. Since the power generator 11 carried out of the movable area RP cannot be operated, the theft of the power generator 11 can be prevented indirectly.

The sound generation unit 1182 is configured to, for example, generate a predetermined warning sound if the theft has occurred. For example, if occurrence of a theft is detected in S1060, the antitheft device 2 outputs, to the power generator 11 as the target of the theft, a control signal for causing the sound generation unit 1182 of the power generator 11 to generate a warning sound. Since a warning sound is generated from the power generator 11 carried out of the movable area RP, the theft can be prevented by directly warning a person involved in the theft.

Note that in this embodiment, a configuration including both the function restricting unit 1181 and the sound generation unit 1182 has been shown. However, one of these may be omitted. Also, the function restricting unit 1181 and/or the sound generation unit 1182 may be provided as a part of a control unit 115.

Figure 8:
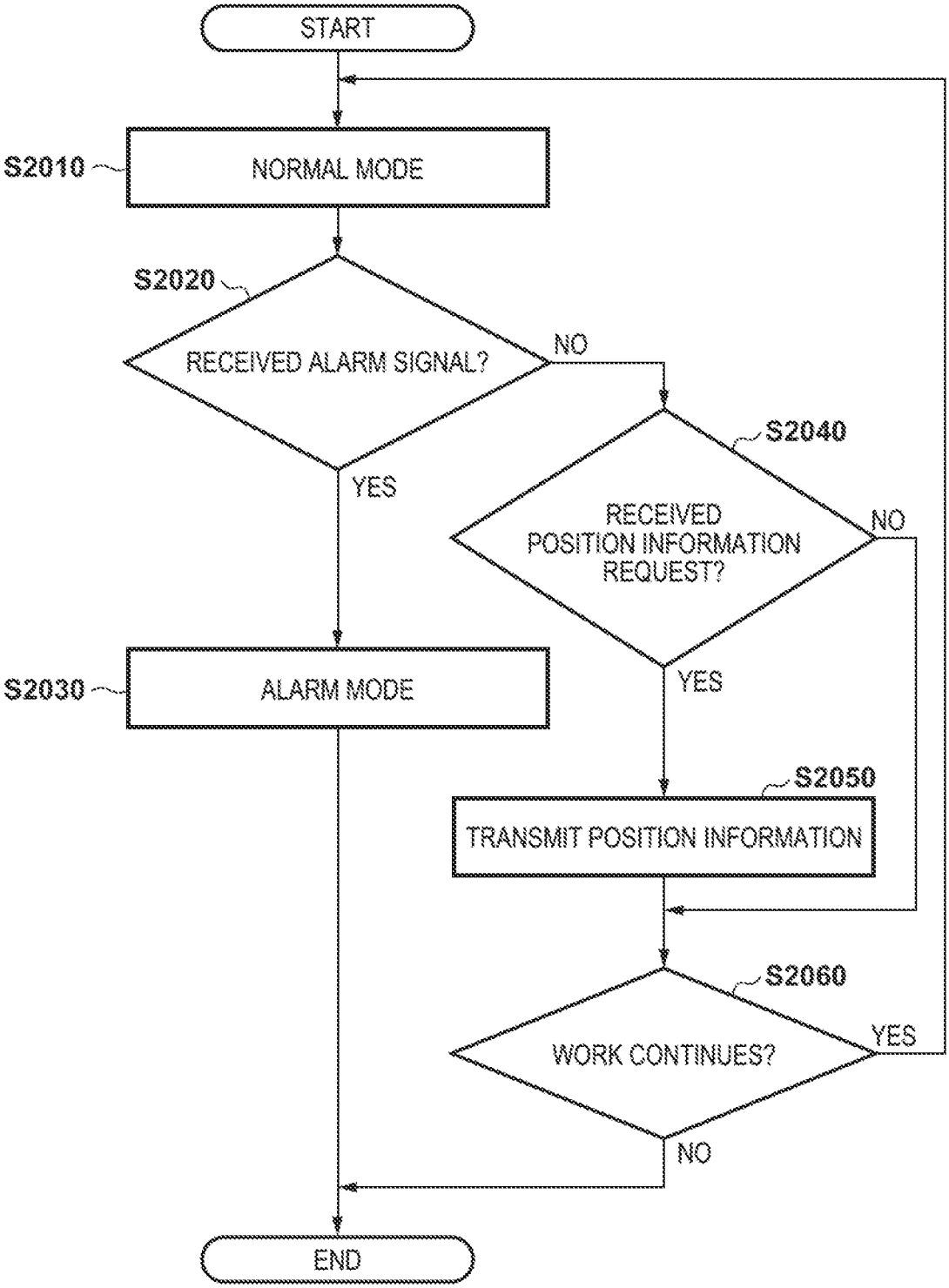
FIG. 8 is a flowchart for explaining an example of the operation contents of the power generator.

FIG. 8 is a flowchart for explaining the operation contents of the power generator 11 according to this embodiment. Each step of this flowchart is mainly executed by the control unit 115. The power generator 11 includes a normal mode and an alarm mode as operation modes. The normal mode is a state in which when a work machine 12 is connected, power can be supplied to the work machine 12. During the time when the power generator 11 is not used for the power supply, the power generator 11 can be arranged at an arbitrary position of a work area RW. On the other hand, in the alarm mode, the function restricting unit 1181 and the sound generation unit 1182 are set in an active state independently of the location of the power generator 11.

In S2010, the power generator 11 is set in the normal mode. The power generator 11 set in the normal mode is then used to supply power to the work machine 12 or can be arranged at an arbitrary position of the work area RW as a reserve.

In S2020, it is determined whether an alarm signal representing that a theft has occurred is received from the antitheft device 2. The alarm signal is output from the antitheft device 2 to the power generator 11 that is the target of the theft if it is determined in S1060 that the theft has occurred. If the power generator 11 receives the alarm signal, the process advances to S2030. Otherwise, the process advances to S2040.

In S2030, the power generator 11 is set in the alarm mode in accordance with the reception of the alarm signal, and the function restricting unit 1181 and the sound generation unit 1182 change to the active state. This makes the power generator 11 inoperable, and a predetermined warning sound is generated by the power generator 11.

In S2040, since the alarm signal is not received, the power generator 11 remains in the normal mode. In S2040, it is determined whether a request representing that position information should be transmitted to the antitheft device 2 is received from the antitheft device 2. This request corresponds to each of S1020 and S1040 from the viewpoint of the antitheft device 2 (see FIG. 3). Upon receiving the request, the process advances to S2050. Otherwise, the process advances to S2060.

In S2050, position information obtained by a sensor unit 114 is transmitted to the antitheft device 2 in response to the transmission request in S2040.

In S2060, it is determined whether the work is in a continuous state. If the work continues, the process returns to S2020. Otherwise (if the work is completed), the flowchart is ended. This step corresponds to S1080 from the viewpoint of the antitheft device 2 (see FIG. 3).

According to this embodiment, it is possible to obtain the effects of the above-described first embodiment, and it is also advantageous in further improving the antitheft effect.

(Modifications)

In the above-described embodiments, the antitheft device 2 is a server installed apart from at least the power generator 11. However, the antitheft device 2 may be incorporated in each of some/all of the plurality of power generators 11. For example, if the antitheft device 2 is provided in each of the plurality of power generators 11 (all of the plurality of power generators 11), the plurality of power generators 11 mutually monitor the presence/absence of occurrence of a theft of the power generators.

Summary of Embodiment

The first aspect is related to an antitheft device (for example, 2), and the antitheft device is an antitheft device for a power generator (for example, 11) electrically connectable to a work machine (for example, 12), characterized by comprising acquisition means (for example, 21, 22, S1020) for acquiring position information from each of a plurality of power generators (for example, 11), setting means (for example, 21, 22, S1030) for setting a single area including positions of the plurality of power generators as a movable area (for example, RP) based on the position information acquired by the acquisition means, and notification means (for example, 21, 22, S1070) for making a predetermined notification if at least one of the plurality of power generators has moved out of the movable area set by the setting means. According to the first aspect, the movable area of the power generators is set based on the pieces of position information of the plurality of power generators, thereby preventing a theft of the power generators relatively easily.

In the second aspect, the antitheft device is characterized by further comprising registration means (for example, 21, 22) for, if a certain power generator (for example, 11*a*) is set in an operation state, registering the power generator and another power generator (for example, 11) located within a first distance (for example, L1) from the power generator as the plurality of power generators. According to the second aspect, the above-described movable area can be set using the substantial start of a work as a trigger.

In the third aspect, the antitheft device is characterized by further comprising registration means (for example, 21, 22) for, if a certain power generator (for example, 11*a*) is connected to the work machine (for example, 12), registering the power generator, and another power generator (for example, 11) located within a first distance (for example, L1) from the power generator and/or the work machine as the plurality of power generators. Accordingly, the same effects as in the second aspect can be obtained.

In the fourth aspect, the antitheft device is characterized in that the registration means registers the plurality of power generators when the work machine connected to the certain power generator changes to an operation state. Accordingly, the same effects as in the second and third aspects can be obtained.

In the fifth aspect, the antitheft device is characterized in that user information is set in advance in the plurality of power generators, and the registration means registers, as the plurality of power generators, the certain power generator and another power generator in which the same user information as that of the power generator is set. This prevents an irrelevant power generator from erroneously being set to a target to be protected from a theft.

In the sixth aspect, the antitheft device is characterized in that the setting means sets the movable area to envelop a plurality of areas (for example, R2) within a second distance (for example, L2) smaller than the first distance from the positions of the plurality of power generators. This makes it possible to appropriately set the above-described movable area for any power generator in a work site.

In the seventh aspect, the antitheft device is characterized in that if the power generator has moved out of the movable area, the notification means outputs, to the power generator, a control signal for causing the power generator to generate a warning sound. According to the seventh aspect, a theft of the power generator is prevented by the warning sound.

In the eighth aspect, the antitheft device is characterized in that if the power generator has moved out of the movable area, the notification means outputs, to the power generator, a control signal for restricting an operation of the power generator. According to the eighth aspect, the operation of the power generator in a place apart from a work site is restricted, thereby preventing a theft of the power generator.

The ninth aspect is related to a power generator antitheft system (for example, SY), and the system is a power generator antitheft system comprising a plurality of power generators (for example, 11) electrically connectable to a work machine (for example, 12), and an antitheft device (for example, 2) configured to be communicable with each power generator, characterized in that the antitheft device comprises acquisition means (for example, 21, 22, S1020) for acquiring position information from each of the plurality of power generators, setting means (for example, 21, 22, S1030) for setting a single area including positions of the plurality of power generators as a movable area (for example, RP) based on the position information acquired by the acquisition means, and notification means (for example, 21, 22, S1070) for making a predetermined notification if at least one of the plurality of power generators has moved out of the movable area set by the setting means. Accordingly, the same effects as in the first aspect can be obtained.

The present invention is not limited to the above embodiments and various changes and modifications can be made within the spirit and scope of the present invention. Therefore, to apprise the public of the scope of the present invention, the following claims are made.

The invention claimed is:

1. An antitheft device for a power generator electrically connectable to a work machine, comprising at least one processor circuit with a memory comprising instructions, that when executed by the processor circuit, cause the at least one processor circuit to at least:

acquire position information from each of a plurality of power generators;

set a single area including positions of the plurality of power generators as a movable area based on the position information;

make a predetermined notification if at least one of the plurality of power generators has moved out of the movable area; and register, if a certain power generator is set in an operation state, the power generator and another power generator located within a first distance from the power generator as the plurality of power generators.

2. The antitheft device according to claim 1, wherein user information is set in advance in the plurality of power generators, and the certain power generator and another power generator in which the same user information as that of the power generator is set, are registered as the plurality of power generators.

3. The antitheft device according to claim 1, wherein the movable area is set to envelop a plurality of areas within a second distance smaller than the first distance from the positions of the plurality of power generators.

4. The antitheft device according to claim 1, wherein if the at least one power generator has moved out of the movable area, a control signal for causing the at least one power generator to generate a warning sound is output to the at least one power generator.

5. The antitheft device according to claim 1, wherein if the at least one power generator has moved out of the movable area, a control signal for restricting an operation of the at least one power generator is output to the at least one Power generator.

6. An antitheft device for a power generator electrically connectable to a work machine, comprising at least one processor circuit with a memory comprising instructions, that when executed by the processor circuit, cause the at least one processor circuit to at least:

acquire position information from each of a plurality of power generators;

set a single area including positions of the plurality of power generators as a movable area based on the position information;

make a predetermined notification if at least one of the plurality of power generators has moved out of the movable area; and register, if a certain power generator is connected to the work machine, the power generator, and another power generator located within a first distance from the power generator and/or the work machine as the plurality of power generators.

7. The antitheft device according to claim 6, wherein the plurality of power generators are registered when the work machine connected to the certain power generator changes to an operation state.

8. A power generator antitheft system comprising a plurality of power generators electrically connectable to a work machine, and an antitheft device configured to be communicable with each power generator, wherein the antitheft device comprises at least one processor circuit with a memory comprising instructions, that when executed by the processor circuit, cause the at least one processor circuit to at least:

acquire position information from each of the plurality of power generators;

set a single area including positions of the plurality of power generators as a movable area based on the position informations;

make a predetermined notification if at least one of the plurality of power generators has moved out of the movable area; and resister, if a certain power generator is set in an operation state, and/or if a certain power generator is connected to the work machine, the power generator and another power generator located within a first distance from the power generator as the plurality of power generators.

* * * * *